US008336760B2

(12) United States Patent
Skouboe

(10) Patent No.: US 8,336,760 B2
(45) Date of Patent: Dec. 25, 2012

(54) PARCEL BOX FOR RECEIVING AND KEEPING PARCELS IN A THEFTPROOF MANNER

(76) Inventor: Peter Skouboe, Gentofte (DK)

( * ) Notice: Subject to any disclaimer, the term of this patent is extended or adjusted under 35 U.S.C. 154(b) by 0 days.

(21) Appl. No.: 13/264,462

(22) PCT Filed: Apr. 6, 2010

(86) PCT No.: PCT/EP2010/054557

§ 371 (c)(1),
(2), (4) Date: Oct. 14, 2011

(87) PCT Pub. No.: WO2010/118973

PCT Pub. Date: Oct. 21, 2010

(65) Prior Publication Data

US 2012/0031960 A1 Feb. 9, 2012

(30) Foreign Application Priority Data

Apr. 17, 2009 (EP) ..... 09158117

(51) Int. Cl.
*B65G 11/04* (2006.01)

(52) U.S. Cl. ..... 232/48; 232/45; 312/211; 312/333

(58) Field of Classification Search ..... 232/44–45, 232/47–51, 17, 24; 312/211–212, 330.1, 312/333, 334.1
See application file for complete search history.

(56) References Cited

U.S. PATENT DOCUMENTS

| | | | | | |
|---|---|---|---|---|---|
| 1,417,773 | A | | 5/1922 | Schulze | |
| 1,471,899 | A | * | 10/1923 | Koenig | 232/17 |
| 1,472,690 | A | * | 10/1923 | Skinner | 232/12 |
| 1,558,026 | A | | 10/1925 | Lyons | |
| 3,099,389 | A | * | 7/1963 | Vadnai | 232/24 |
| 3,401,875 | A | * | 9/1968 | Bruhns | 232/34 |
| 4,278,308 | A | * | 7/1981 | Gotberg | 312/330.1 |
| 4,344,661 | A | * | 8/1982 | Gotberg | 312/330.1 |
| 4,753,386 | A | * | 6/1988 | Phillion, Sr. | 232/43.1 |
| 4,844,332 | A | * | 7/1989 | Long | 232/17 |

(Continued)

FOREIGN PATENT DOCUMENTS

| | | | |
|---|---|---|---|
| CH | 583 544 | A5 | 1/1977 |
| CH | 597 810 | A5 | 4/1978 |
| WO | 01/15579 | A1 | 3/2001 |
| WO | 01/93729 | A1 | 12/2001 |
| WO | 03/026466 | A1 | 4/2003 |

OTHER PUBLICATIONS

International Search Report from PCT/EP2010/054557 dated Aug. 19, 2010 (3 pages).

(Continued)

*Primary Examiner* — William L. Miller
(74) *Attorney, Agent, or Firm* — Osha Liang LLP

(57) ABSTRACT

A parcel box for receiving and keeping parcels in a theftproof manner has a box having a drawer which can be pulled out and pushed in, and a prevention mechanism that prevents unauthorized removal of parcel. The prevention mechanism has a placing portion on which the parcel is placed, a blocking mechanism that blocks pulling out of the drawer from the box when parcel is placed on the placing portion, and an unblocking mechanism that unblocks the parcel box drawer. The placing portion has two platforms, each having a first end and a second end situated opposite each other. The two platforms are facing each other or are placed in adjacent relation to each other, with the ends of the platforms directed to opposite sides. Each platform is pivotable about a pivot axle fixed in the drawer.

20 Claims, 5 Drawing Sheets

U.S. PATENT DOCUMENTS

| | | | | |
|---|---|---|---|---|
| 5,833,132 | A * | 11/1998 | Bachmeier | 232/47 |
| 6,375,071 | B1 * | 4/2002 | Kim | 232/47 |
| 6,588,656 | B2 * | 7/2003 | Cox et al. | 232/47 |
| 6,655,577 | B2 * | 12/2003 | Mihaylov et al. | 232/45 |
| 7,036,719 | B1 * | 5/2006 | Helphrey et al. | 232/47 |
| 7,175,068 | B2 * | 2/2007 | Fitzgibbons et al. | 232/31 |
| 7,182,246 | B1 * | 2/2007 | Sievel | 232/45 |
| 7,249,705 | B2 * | 7/2007 | Dudley | 232/47 |
| 7,913,898 | B2 * | 3/2011 | Frankenberg et al. | 232/45 |
| 2005/0258227 | A1 | 11/2005 | Flores | |
| 2012/0024942 | A1 * | 2/2012 | Skouboe | 232/24 |

OTHER PUBLICATIONS

Written Opinion from PCT/EP2010/054557 dated Aug. 19, 2010 (4 pages).

International Search Report from PCT/EP2010/054556 dated Jul. 20, 2010 (2 pages).

Written Opinion from PCT/EP2010/054556 dated Jul. 20, 2010 (3 pages).

* cited by examiner

PARCEL BOX FOR RECEIVING AND KEEPING PARCELS IN A THEFTPROOF MANNER

BACKGROUND

1. Technical Field

This invention relates to apparatus for ensuring the secure delivery of mail and parcels to household or business premises. More specifically, the invention relates to parcel box for receiving and keeping parcels in a theft-proof manner.

2. Background Art

With a growing interne trade and purchase of goods online there has been an increase in the delivery of goods to the home. Since ordered goods are usually too big to fit through standard mail box, to ensure safe receipt of the ordered goods the customer is required either to be at home at the moment of delivery, or to collect these goods from a post office or seller's storehouse. Therefore there is a need in parcel box on the one part having sufficient capacity to be able to receive large-size articles, and on the other part having means preventing unauthorized removal of articles delivered in absence of addressee.

There are known parcel boxes with different types of locking mechanisms for secure delivery of parcels having a door with means for locking the door when parcel is placed in the parcel room.

Different types of locking mechanisms for parcel box are suggested in CH 597810 ("Mail box", Int. Cl.$^2$ A47G 29/16, publ. 14 Apr. 1978). According to invention disclosed in CH 597810, it is suggested using box in the form of parallelepiped having single-swing door.

The door's locking is ensured by lever with latch being put in position of locking by pushing or pulling means actuated by restoring spring and parcel placed in the parcel room.

In one embodiment of the known technical solution, the parcel when being put in the parcel room pushes the plate, which actuates lever with latch locking the door of the parcel box. In the another embodiment, the weight of parcel put in the parcel room forces platform downward, which actuates lever with latch locking the door of the parcel box.

The door is then unlocked by the owner's key. A major drawback of the known device is that the locking arrangement located in the inner part of the parcel box requires much space for its operation, thus limiting the usable inner area of the parcel box and the size of the parcel, which may be placed therein. Moreover, such locking arrangement contains a number of elements, which have quite short durability and thus limiting the life time of the locking arrangement.

There is known a parcel box having a single-swing door openable, when no parcel is in the box, wherein, once closed with a parcel placed in the box, the door is blocked thereby preventing unwanted removal of the parcel placed therein (WO01/15579A1 "Secure article delivery apparatus and method", Int. Cl.$^7$ A47G 29/14, publ. 8 Mar. 2003). When a parcel is placed in the box on a raised platform, the weight of the parcel forces the platform downwardly, against the action of biasing means such as helical or leaf springs. Once the parcel has been placed in the box, the door is closed. During the closure process the platform is lifted by cam means attached to door. As a result a dowel attached to the side of platform rises above a latch fitted to the inside face of the door as part of projection. At the moment that the door is fully closed, dowel overlies a recess formed by latch. Simultaneously, wedges line up with recesses provided in platform and the platform drops under the influence of the weight of the parcel placed thereon. Locking means such as a key operated lock attached to the side of the box prevents a lower portion of the latch from being pushed back and releasing the door. If a parcel is on the platform, the only way of opening the door is to unlock the lock which frees dowel. A major drawback of the known parcel box is that proper work of the locking arrangement depends on which part of the raised platform the parcel is placed. Also, the lifetime of the locking arrangement is limited due to using of springs and other parts which have limited work resources.

There is known a parcel box (WO/2001/93729 "Locking arrangement", Int. Cl.$^7$ A47G 29/20, publ. 13 Dec. 2001) with a door pivotally hinged in a casing and provided with a locking arrangement for the said door. This locking arrangement comprises a spring-loaded lock on the door with an associated strike plate on the casing, and a vertically movable support for a parcel. The vertically movable support assumes a lower position in unloaded state and an upper position in loaded state. The strike plate is pivotally mounted about a swiveling axis but has a blocking position in which at least a part of the strike plate is extending in over the blocking pawl of the spring-loaded lock when the door is closed, and is locked in the blocking position by the support when this support is in its lower position. The main drawback of the known device is that construction of its locking arrangement while being quite complicated and rather expensive, is not reliable, because different areas of the vertically movable support have different sensitivity and thus, the operation of this locking arrangement depends on which part of the vertically movable support the parcel is placed. If the parcel is placed near the back wall of the box, the bottom is not being weighed down into the locking position.

There is known a parcel box (WO/2003/026466 "A case for receiving and keeping parcels in a theftproof manner", Int. Cl.$^7$ A47G 29/20, publ. 3 Apr. 2003) with a door pivotally mounted on the case of the box by means of hinges and having locking arrangement with a pivotal locking lever, which is fitted between two bottoms of the parcel box, and is connected to the lower end part of the locking bar at one end and at the other end, to a swing axle extending transversally of the locking lever and rotatably journaled in the upper bottom. The swing axle is provided with projecting supporting arm which has a support base located at a distance from the swing axle, and that the support base is supporting against the lower bottom when the upper bottom is forced down towards the lower bottom by the weight of parcel placed on the upper bottom. When the parcel is weighing the movable upper bottom down towards the fixed lower bottom, the support base is made to support against the last mentioned bottom. Thereby, the supporting arm pivots the swing axle and thereby the swing arm which again pushes the locking bar up or down so that the locking arrangement is activated. The main drawback of the known parcel box is also insufficient reliability of the locking arrangement. For proper work of the case the parcel should be placed on upper bottom over transversally extending swinging axle or sufficiently close to it. In case a postman will place the parcel at a distance from the transversally extending swinging axle, the locking arrangement will not work properly.

There is known a parcel box (U.S. Pat. No. 1,417,773 "Deposit and collection receptacle", Int. Cl. A47G 19/20, publ. 30 May 1922) comprising a receptacle provided with an inwardly swinging door, a floor within the receptacle supported for swinging movement, a portion of the floor adjacent the door normally swinging downwardly by gravity, and a latch pivotally supported by said portion of the floor and normally swinging upwardly, said normally depressed portion of the floor swinging upwardly upon imposing weight upon the opposite portion of the floor, said latch holding the door against inward swinging movement when said normally depressed portion of the floor is elevated.

There is known a parcel box (U.S. Pat. No. 1,558,026 "Milk-bottle receptacle", Int. Cl. A47G 29/20, publ. 20 Oct. 1925) comprising a housing providing a chamber to which communication is gained through an opening in the top of the said housing; lever members extending upwardly on opposite sides of and within said chamber, said lever members having inwardly projecting shelves at their lower ends and being pivoted at their lower ends so that the upper ends of said lever members will swing inwardly when said shelves are depressed; and a door member pivoted at each side of said opening and adapted to hang down in front of the upper end of one of said lever members, the under faces of said doors being arcuated to conform with the arcs described by the upper ends of said lever members as they swing inwardly.

Large sized parcel boxes are usually placed on the floor inside or outside of household properties. In the apartment buildings a number of parcel boxes may be put one to another. To put a parcel in the parcel box standing on the level, which is lower than the user's waist, the user has to bend down or squat. The user taking out the parcel has to perform similar operations and reach to the parcel placed deep in the parcel box. In such cases another disadvantage of the known parcel boxes is that they are quite inconvenient in use, especially when placed on the floor.

SUMMARY

One or more embodiments of the present invention provides a parcel box for receiving and keeping parcels in a theftproof manner.

According to one or more embodiments of the present invention, a parcel box comprises sufficient capacity to be able to receive large-sized articles, means preventing unauthorized removal of articles delivered in absence of addressee, simple, inexpensive, reliable and easy-to-use construction, as well as is convenient in use, especially when placed on the floor or standing on the level, which is lower than its owner's waist.

According to one or more embodiments of the present invention, a parcel box comprises a box with a drawer which can be pulled out and pushed in, and means preventing unauthorized removal of parcel, comprising means for placing the parcel, means blocking pulling out of the drawer from the parcel box when parcel is placed on the means for placing the parcel and means for unblocking the parcel box drawer. The means for placing the parcel comprise two or more platforms, each having a first and a second end situated opposite each other, the ends of the platforms are being directed to the opposite sides, the platforms each being pivotable about its own pivot axle fixed in the drawer, hereto, the platforms being provided with a connecting member; at least one platform is connected to a counterbalance by using means for connecting the counterbalance with at least one platform, so that the first ends of the platforms are situated lower than the second ends when there is no parcel on the platforms. The means for placing the parcel further comprise the means blocking pulling out of the drawer from the box when parcel is placed on the means for placing the parcel comprising a blocking bracket having a first end and a second end, the blocking bracket being engaged, or fixed, or hingedly connected to the connecting member, or at least to one platform, or to means for connecting the counterbalance with at least one platform, with ability of vertical movement upon changing position of the second ends of the platforms. The means blocking pulling out of the drawer from the box further comprise a seat, or stop fixed in the box for engagement with the second end of the blocking bracket when parcel is placed on the second end of the platform.

When there is no parcel on the platforms the counterbalance holds the blocking bracket in disengaged position. In this position the drawer can be pulled out and pushed in again and again. When the parcel is put on the platforms, the second ends of the platforms go down, thus causing the blocking bracket to sink. As soon, as the drawer is pushed into the box, the second end of the blocking bracket engages with the stop or walls of the seat, thus blocking pulling out of the drawer from the box.

Use of drawer ensures the convenience in use of the parcel box, especially when placed on the floor or standing on the level, which is lower than its owner's waist. To put in or take out the parcel, the user has to pull out the drawer and put or take the parcel. That is much more convenient than use of traditional parcel box with single swing door pivotally mounted on the case of the box. The drawer according to one or more embodiments of the present invention is mounted on guiding means, such as rails or guide roller.

The means for preventing unauthorized removal of parcel according to one or more embodiments of the present invention have simple, inexpensive, reliable and easy-to-use construction; they are sufficiently sensitive to react on lightweight parcel, regardless on which part of the platform the parcel is placed.

However weight sensitivity of the parcel box can also be adjusted, according to needs. The offered means for preventing unauthorized removal of parcel allow using simple mechanism of the means for signaling the presence of the parcel in the parcel box. Also, the suggested means for preventing unauthorized removal of parcel require less space for operation and have longer lifetime if compared with the most of prior art technical solutions.

Further, substance of the invention and its various embodiments are described by way of examples with references to the drawings.

DETAILED DESCRIPTION

Hereafter, embodiments of the invention will be described. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
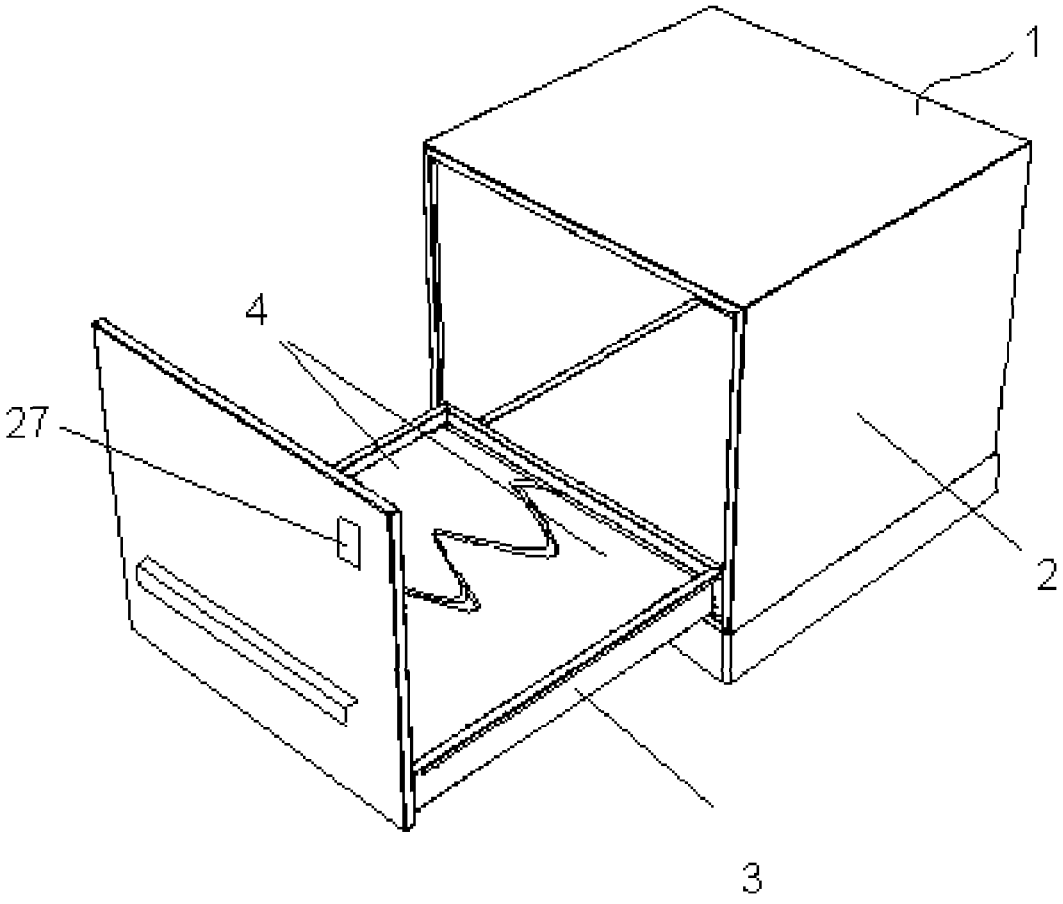
FIG. 1 represents general view of the parcel box.

Parcel box 1 for receiving and keeping parcels in a theft-proof manner comprises a box 2 and a drawer 3 (FIG. 1) comprising means preventing unauthorized removal of parcel. The means preventing unauthorized removal of parcel comprise means for placing the parcel, means blocking pulling out of the drawer 3 from the box 2 when parcel is placed on the means for placing the parcel and means for unblocking opening the parcel box. The means for placing the parcel comprise at least two platforms 4, each having a first 5 and a second 6 end situated opposite each other. In one or more embodiments of the present invention, as shown on FIG. 2 and FIG. 3, the means for placing the parcel comprise two platforms 4, facing each other or placed in adjacent relation, thereby the ends 5 of the platforms 4 are being directed to the opposite sides.

Figure 4:
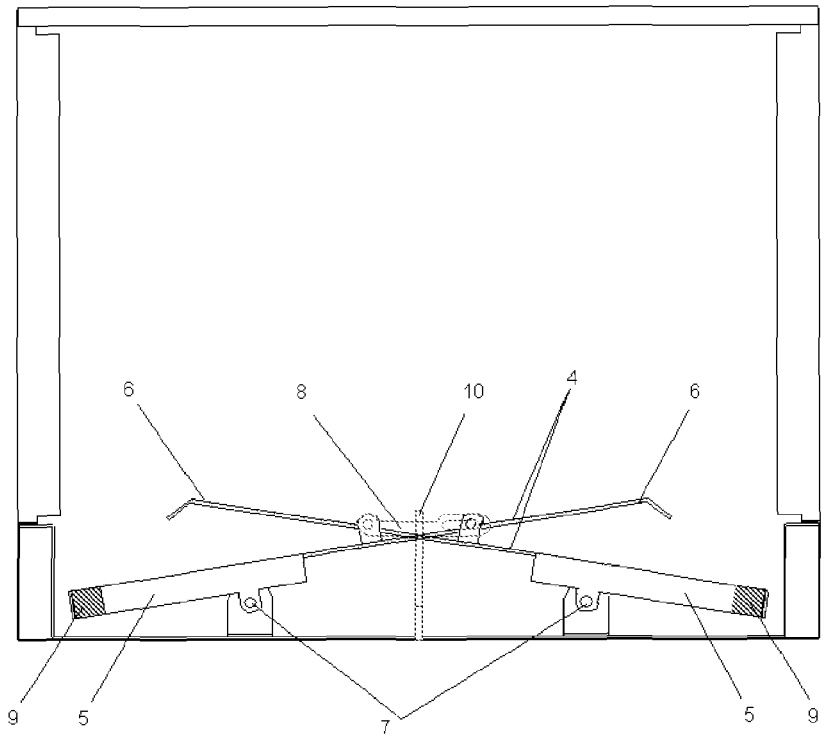
FIG. 4 represents a rear view cross-section of another embodiment of the parcel box in unblocked position (with no parcel inside).

Each platform 4 is being pivotable about its own pivot axle 7, which is fixed in the drawer 3. The platforms 4 are provided by connecting member 8, ensuring synchronous movement of the platforms 4. The first ends 5 of the platforms 4, according to one or more embodiments of the present invention, are shorter than the second ends 6. At least one platform 4 is connected to the counterbalance 9 by the use of the means for connecting the counterbalance 9 with at least one platform 4, so that the first ends 5 of the platforms 4 are situated lower than the second ends 6 when there is no parcel on the platforms 4. The drawer 3 according to one or more embodiments is provided with the guiding means G for guiding the counterbalance 9. According to another embodiment (FIG. 4), the first end 5 of at least one platform 4 is provided by the counterbalance 9.

The means blocking pulling out of the drawer 3 from the box 2 when parcel is placed on the means for placing the parcel comprise a blocking bracket 10 having a first end 11 and a second end 12, the blocking bracket 10 being engaged, or fixed, or hingedly connected to the connecting member 8, or at least one platform 4, or means for connecting the counterbalance 9 with at least one platform 4, with ability of vertical movement upon changing position of the second ends 6 of the platforms 4. The means blocking pulling out of the drawer 3 from the box 2 when parcel is placed on the means for placing the parcel further comprise a seat in the parcel box, or a stop 13 fixed in the box 2 for engagement with the second end 12 of the blocking bracket 10 when parcel is placed on the second end 6 of the platform 4, and thereby the second end 12 of the blocking bracket 10 is in its lower position.

Figure 2:
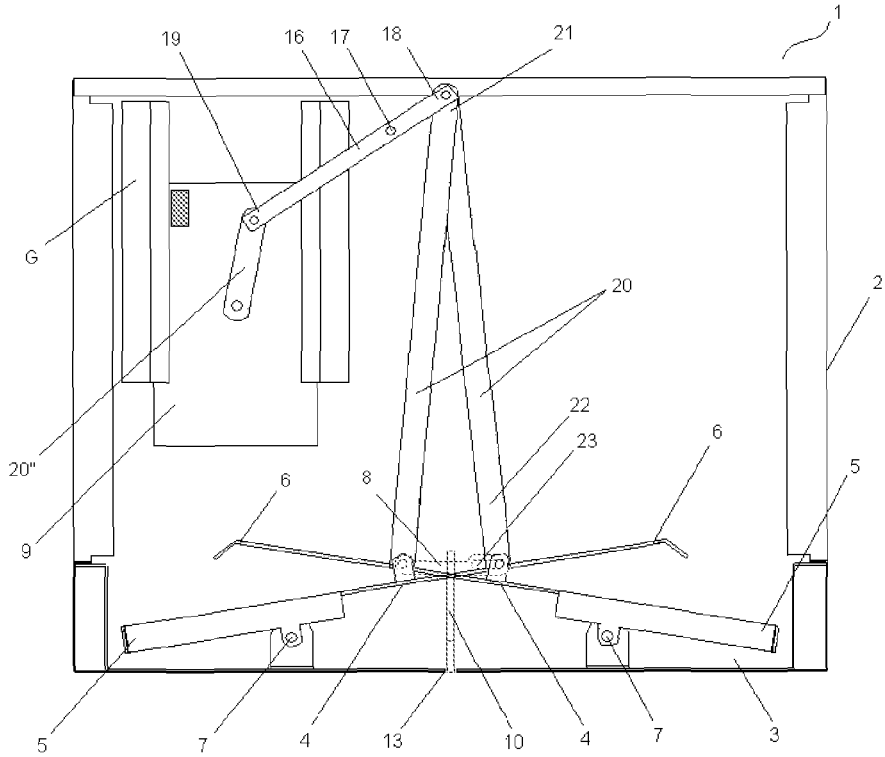
FIG. 2 represents a rear view cross-section of embodiment of the parcel box in unblocked position (with no parcel inside).
Figure 3:
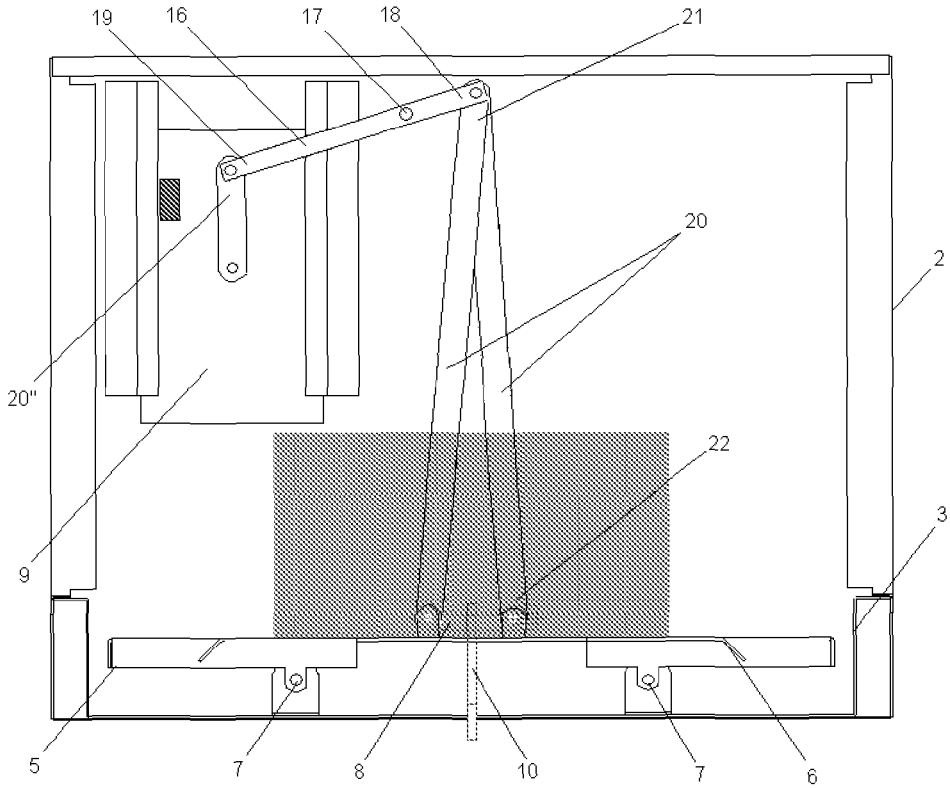
FIG. 3 represents a rear view cross-section of embodiment of the parcel box in blocked position (when the parcel is inside).
Figure 5:
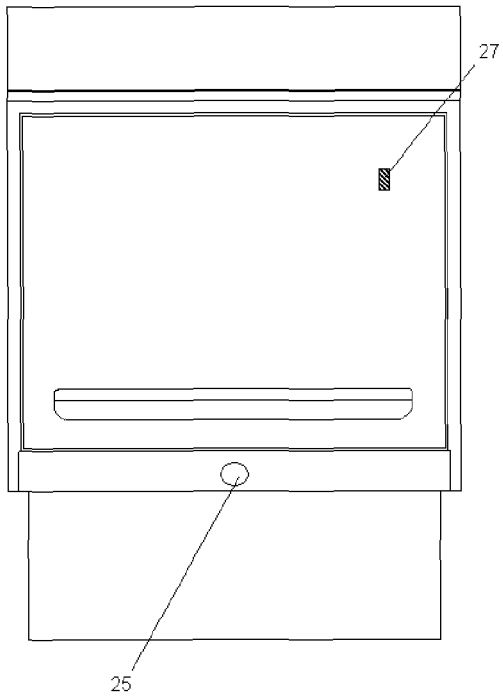
FIG. 5 represents front view of the parcel box.
Figure 6:
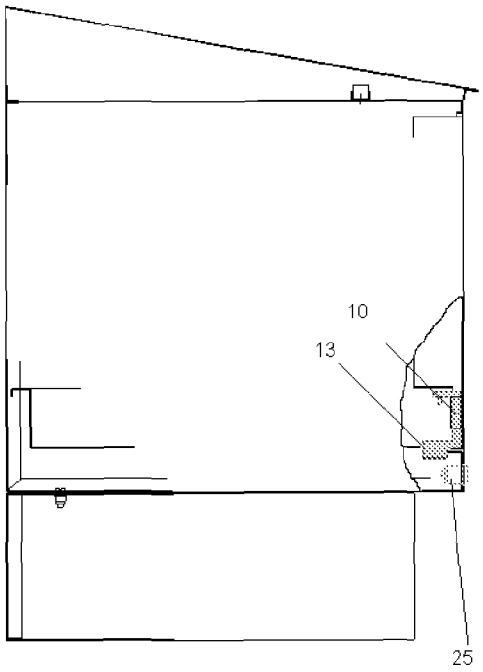
FIG. 6 represents schematic side view of the blocking bracket of the parcel box in blocked position (when the parcel is inside).

According to one or more embodiments of the present invention, the blocking bracket 10 is placed on (releasably engaged with) the connecting member 8 as shown in FIG. 2, so that upon sinking of the second ends 6 of the platforms 4, the blocking bracket 10 would sink forced by the gravitation and thereby the second end 12 of the blocking bracket 10 would engage with the seat, or stop 13 in the box 2 (FIGS. 3 and 5).

The platforms 4 according to one or more embodiments of the present invention have protuberances 14 and recesses 15 formed along each edge of the second ends 6 of the platforms 4 (FIGS. 8A-8F). These recesses 15 are extending in the length direction of the platforms 4 and are located, so that protuberances 14 of one platform 4 can be accommodated in the recesses 15 of another platform 4. The recesses 15 according to one or more embodiments of the present invention extend from 0.01 to 0.99 of the length of the platform 4, and according to one or more embodiments of the present invention, from 0.30 to 0.80 of the length of the platform 4. The protuberances 14 have a length sufficient to be accommodated in the recesses 15 and to ensure some clearance between protuberances 14 and recesses 15. The protuberances 14 may be rounded, oval, rectangular or triangular in shape, as shown in FIGS. 8A-8F. However the protuberances 14 may be of any other shape too. The recesses 15 should have the shape corresponding to the shape of the protuberances 14 to be able to accommodate them.

The means for connecting the counterbalance 9 to at least one platform 4 according to one or more embodiments of the present invention as shown in FIG. 2 and FIG. 3 comprise a rocking arm 16 pivotally mounted on axle 17, said rocking arm 16 having a first 18 and a second 19 end, the second end 19 is being fixed or connected to the counterbalance 9; the second end 19 of the rocking arm 16 may be connected to the counterbalance 9 directly (according to one or more embodiments of the present invention, via axle), or via rocking lever 20", —a rocking lever 20, two rocking levers 20, each having a first end 21 pivotally mounted to the first end 18 of the rocking arm 16 and a second end 22 pivotally mounted to the second end 6 of the platform 4.

In yet another embodiment the means for connecting the counterbalance 9 to the at least one platform 4 comprise a wire rope having a first and a second end and passing over an axle. The first end of the wire rope is connected to the second end 6 of the platform 4 and the second end of the wire rope is connected to the counterbalance 9.

The connecting member 8 is connected to the second ends 22 of the rocking levers 20 (FIG. 2). The connecting member 8 is being in the form of a plate, according to one or more embodiments of the present invention is slightly upwards curved, having a slot 23, which extends at least along part of the length of the plate, hereto, the second ends 22 of the rocking levers 20 are connected to the connecting member 8 and the second end 22 of at least one rocking lever 20 is able to travel in the slot 23, when the ends 6 of the platforms 4 are changing their positions.

Figure 7:
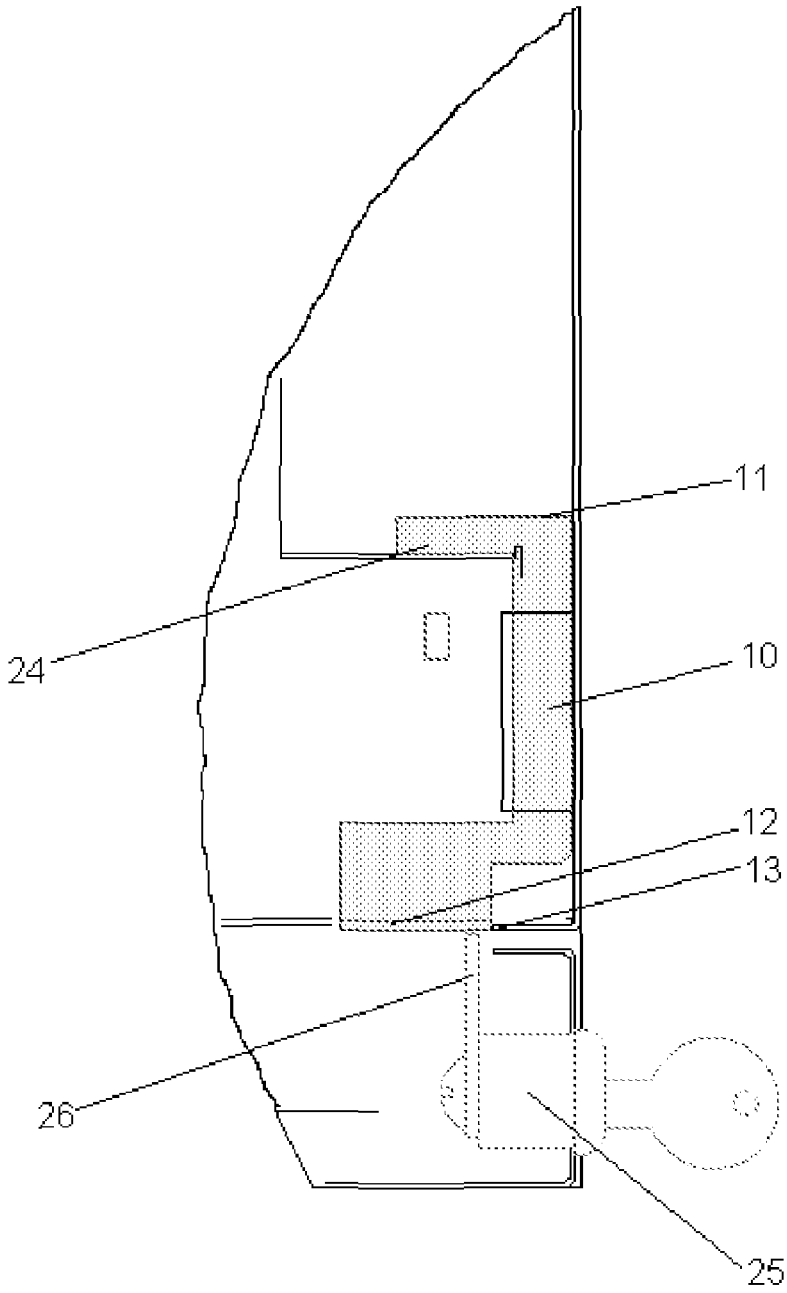
FIG. 7 represents side view of the means for unblocking opening of the parcel box drawer.
Figure 8A:
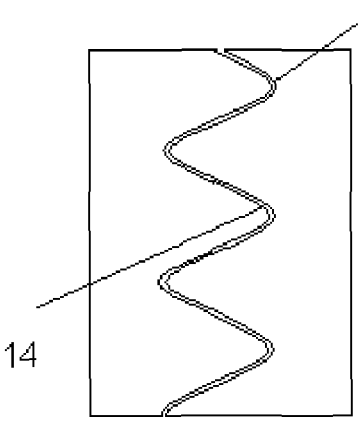
FIGS. 8A-8F represent schematic top view of different embodiments of the platforms for placing the parcel.
Figure 8B:
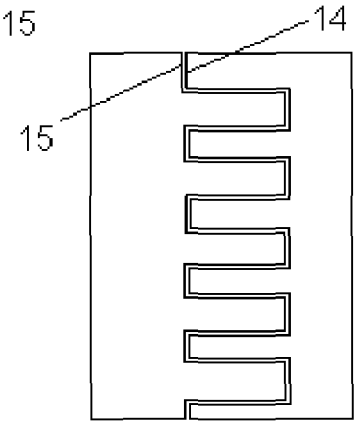
Figure 8C:
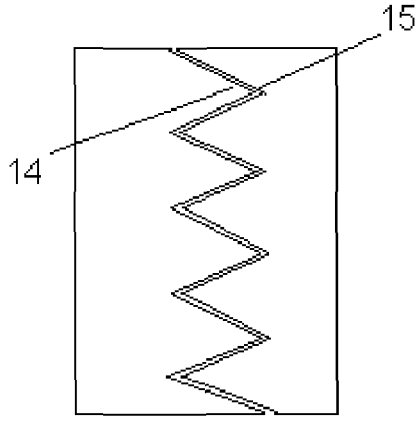
Figure 8D:
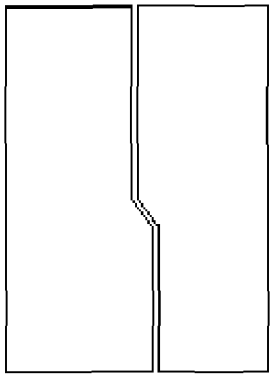
Figure 8E:
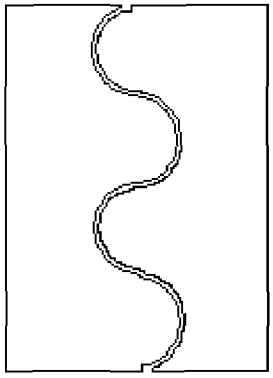
Figure 8F:
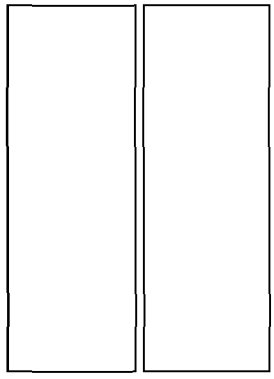

The first end 11 of the blocking bracket 10 is provided by projection 24 (FIG. 7) for engagement with the connecting member 8, or at least one platform 4, or means for connecting the counterbalance 9 with at least one platform 4, hereto the first end 11 of the blocking bracket 10 is placed on the connecting member 8, or at least one platform 4, or means for connecting the counterbalance 9 with at least one platform 4.

The means for unblocking the parcel box 1 drawer 3 comprise means for lifting the blocking bracket 10.

According to one embodiment of the invention (FIG. 7), the means for lifting the blocking bracket 10 comprise a lock 25 with a rocking lever 26 (the lock's claw) or equivalent means for engagement with the second end 12 of the blocking bracket 10, wherein the lock 25 with the rocking lever 26 is mounted in the box 1 under the second end 12 of the blocking bracket 10. The rocking lever 26 being pivotal to a first position, in which it is disengaged with the second end 12 of the blocking bracket 10, as well as to a second position, in which it is engaged with the second end 12 of the blocking bracket 10 and thereby lifting the blocking bracket 10 and disengaging the second end 12 from a seat, or stop 13.

In yet another embodiment of the invention, the means for lifting the blocking bracket 10 comprise the lock 25 with the rocking lever 26 mounted above the blocking bracket 10, a wire rope having a first and a second end, wherein the first end of the wire rope is connected to the rocking lever 26 and the second end of the wire rope is connected to the first end 12 of the blocking bracket 10.

In one or more embodiments of the invention the drawer 3 comprises signaling means for signaling the presence of the parcel in the parcel box 1. The signaling means are in the form of an aperture 27 in the outer wall of the drawer 3 (FIGS. 1 and 4), the counterbalance 9 mounted so as to allow its vertical sliding translational movement along the said outer wall of the drawer 3, the said counterbalance 9 being provided by color label, or equivalent indicating means allowing to distinguish between the upper and lower position of the counterbalance 9, wherein the said color label, or equivalent indicating means (such as notch or cut off on its peripheral or outer part allowing user to distinguish between "empty" and "parcel inside" positions) are placed, so that one respective indicating means is visible through the said aperture 27 in the outer wall of the drawer 3.

The parcel box may be also combined with the mail box comprising a box and a pivotally mounted door with a letter opening, a handle and/or door's support and lock.

According to one or more embodiments of the invention, the drawer 3 is mounted on guiding means, such as rails, wheels, guide rollers or equivalent means allowing easily drawing out and pushing in the drawer 3. The drawer 3 may also contain means, such as magnet or spring, for ensuring closing the drawer back (attracting or pulling up) even when the drawer is not properly closed by the user.

In a "waiting position", i.e. when there is no parcel on the platform 4, the counterbalance 9 outweighs the first ends 5, or raises the second ends 6 of the platform(s) 4. In this position, the blocking bracket 10 is being hold in its upper position by the connecting member 8, or, according to other embodiments—by the at least one platform 4, or means for connecting the counterbalance 9 with at least one platform 4. In the upper position of the blocking bracket 10, the second end 12 of the blocking bracket is disengaged with the seat or stop 13. In this position the drawer 3 can be pulled out and pushed in again and again.

When the parcel is delivered, the courier pulls out the drawer 3, puts the parcel on at least one platform 4. Being forced down by the weight of parcel, the second end 6 of the platform 4 goes down. Since the platforms 4 are connected by the connecting member 8, the second ends 6 of the other platforms 4 also go down synchronically, even if there is no parcel on them. Protuberances 14 of one platform 4 enter into the recesses 15 of another platform 4, thereby, when the second ends 6 of the platforms 4 are in their lower position, the platforms 4 form a plain surface. When the second ends 6 of the platforms 4 go down, the blocking bracket 10 is forced to go down too (either by gravitation, or forced by the second ends 6 of the platforms 4, depending on the embodiment). As soon, as the drawer is pushed into the box 2, the second end 12 of the blocking bracket 10 is sank and is engaged with the seat, or stop 13 in the box 2, thus blocking pulling out of the drawer 3 from the box 2 and preventing unauthorized removal of parcel.

To unlock the parcel box 1, the user inserts the key into the lock 25 and turns the key thereby turning the rocking lever 26 (the lock's claw) or equivalent means, which engage with the second end 12 of the blocking bracket 10 and pushes it up thus disengaging from the seat or the stop 13. According to another embodiment, the rocking lever 26, located above the blocking bracket 10, pulls up the blocking bracket 10 disengaging it the seat or the stop 13. When the second end 12 of the blocking bracket 10 is disengaged from the seat or stop 13, the drawer 3 can be pulled out from the box 2 giving the user access to the parcel.

If the parcel box is equipped with the signaling means the user can see whether there is a parcel in the parcel box from a distance. When there is no parcel in the parcel box 1, the signaling means are set to position "empty", which may be marked by green color. When the parcel is placed on the second end 6 of at least one platform 4, the second ends 6 of both platforms being forced down by the weight of the parcel go down, thus causing the counterbalance 9 to go up, placing the indicating means in position "parcel inside", which may be marked by red color.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A parcel box for receiving and keeping parcels in a theftproof manner comprising:

a box comprising a drawer which can be pulled out and pushed in; and a prevention mechanism that prevents unauthorized removal of a parcel, comprising:

a placing portion on which the parcel is placed, a blocking mechanism that blocks pulling out of the drawer from the box when the parcel is placed on the placing portion, and an unblocking mechanism that unblocks the parcel box drawer, wherein the placing portion comprises two platforms, each having a first end and a second end situated opposite each other, wherein the two platforms are facing each other or are placed in adjacent relation to each other, with the ends of the platforms directed to opposite sides, wherein each platform is pivotable about a pivot axle fixed in the drawer, wherein the platforms are provided with a connecting member ensuring synchronous movement of the platforms, wherein at least one platform is provided with a counterbalance or connected to a counterbalance by a connecting mechanism that connects the counterbalance with at least one platform, so that the first ends of the platforms are situated lower than the second ends when there is no parcel on the platforms, wherein the blocking mechanism comprises a blocking bracket having a first end and a second end, wherein the blocking bracket is engaged, fixed, or hingedly connected to the connecting member, at least to one platform, or to the connecting mechanism, with ability of vertical movement upon changing position of the second ends of the platforms, a seat, or stop fixed in the box for engagement with the second end of the blocking bracket when the parcel is placed on the second end of the platform.

2. The parcel box according to claim 1, wherein the platforms have protuberances and recesses formed along each edge of the second ends of the platforms and located, so that protuberances of one platform can be accommodated in the recesses of another platform.

3. The parcel box according to claim 2, wherein the connecting mechanism comprises a rocking arm and two rocking levers, wherein the rocking arm is pivotally mounted on an axle, wherein the rocking arm has a first end and a second end, wherein the second end is fixed or connected to the counterbalance, and wherein each of the two rocking levers has a first end pivotally mounted to the first end of the rocking arm and a second end pivotally mounted to the second end of the platform.

4. The parcel box according to claim 3, wherein the connecting member is connected to the second ends of the rocking levers, wherein the connecting member is in the form of a plate having a slot, which extends at least along part of the length of the plate, and wherein the second end of at least one rocking lever is able to travel in the slot, when ends of the platforms are changing positions.

5. The parcel box according to claim 2, wherein the first end of the blocking bracket is provided by projection for engagement with the connecting member, at least one platform, or the connecting mechanism, and wherein the first end of the blocking bracket is placed on the connecting member, at least one platform, or the connecting mechanism.

6. The parcel box according to claim 2, wherein the unblocking mechanism comprises a lifting mechanism that lifts the blocking bracket.

7. The parcel box according to claim 3, wherein the first end of the blocking bracket is provided by projection for engagement with the connecting member, at least one platform, or the connecting mechanism, and wherein the first end of the blocking bracket is placed on the connecting member, at least one platform, or the connecting mechanism.

8. The parcel box according to claim 4, wherein the first end of the blocking bracket is provided by projection for engagement with the connecting member, at least one platform, or the connecting mechanism, and wherein the first end of the blocking bracket is placed on the connecting member, at least one platform, or the connecting mechanism.

9. The parcel box according to claim 1, wherein the connecting mechanism comprises a rocking arm and two rocking levers, wherein the rocking arm is pivotally mounted on an axle, wherein the rocking arm has a first end and a second end, wherein the second end is fixed or connected to the counterbalance, and wherein each of the two rocking levers has a first end pivotally mounted to the first end of the rocking arm and a second end pivotally mounted to the second end of the platform.

10. The parcel box according to claim 9, wherein the connecting member is connected to the second ends of the rocking levers, wherein the connecting member is in the form of a plate having a slot, which extends at least along part of the length of the plate, and wherein the second end of at least one rocking lever is able to travel in the slot, when ends of the platforms are changing positions.

11. The parcel box according to claim 9, wherein the first end of the blocking bracket is provided by projection for engagement with the connecting member, at least one platform, or the connecting mechanism, and wherein the first end of the blocking bracket is placed on the connecting member, at least one platform, or the connecting mechanism.

12. The parcel box according to claim 9, wherein the unblocking mechanism comprises a lifting mechanism that lifts the blocking bracket.

13. The parcel box according to claim 10, wherein the first end of the blocking bracket is provided by projection for engagement with the connecting member, at least one platform, or the connecting mechanism, and wherein the first end of the blocking bracket is placed on the connecting member, at least one platform, or the connecting mechanism.

14. The parcel box according to claim 10, wherein the unblocking mechanism comprises a lifting mechanism that lifts the blocking bracket.

15. The parcel box according to claim 1, wherein the first end of the blocking bracket is provided by projection for engagement with the connecting member, at least one platform, or the connecting mechanism, and wherein the first end of the blocking bracket is placed on the connecting member, at least one platform, or the connecting mechanism.

16. The parcel box according to claim 1, wherein the unblocking mechanism comprises a lifting mechanism that lifts the blocking bracket.

17. The parcel box according to claim 16, wherein the lifting mechanism comprises a lock with a rocking lever for engagement with the second end of the blocking bracket, and wherein the lock with the rocking lever is mounted in the box under the second end of the blocking bracket.

18. The parcel box according to claim 1, wherein the drawer comprises a signaling mechanism provided by color label, notch or cut off on a peripheral or outer part allowing user to distinguish between empty and parcel inside positions.

19. The parcel box according to claim 1, wherein the drawer comprises a signaling mechanism in the form of an aperture in an outer wall of the drawer, wherein the counterbalance is mounted so as to allow vertical sliding translational movement along the outer wall of the drawer, wherein the counterbalance is provided by color label that distinguishes between the upper and lower position of the counterbalance, wherein the color label is placed, so that one color label is visible through the said aperture in the outer wall of the drawer.

20. The parcel box according to claim 1, wherein the parcel box is combined with a mail box comprising a box and a pivotally mounted door with a letter opening, a handle or door's support and lock.

* * * * *